US006299706B1

(12) United States Patent
Miyake et al.

(10) Patent No.: US 6,299,706 B1
(45) **Date of Patent: *Oct. 9, 2001**

(54) PROCESS FOR IMPROVING THE EXTRUDABILITY OF HIGH-STRENGTH ALUMINUM ALLOYS

(75) Inventors: Yoshiharu Miyake; Yoshihisa Serizawa; Yukio Okochi, all of Susono; Tetsuya Suganuma, Nagoya; Hajime Kamio, Ihara-gun; Takayuki Tsuchida, Ihara-gun; Hiroshi Nagashima, Ihara-gun, all of (JP)

(73) Assignees: Toyota Jidosha Kabushiki Kaisha; Nippon Light Metal, Co., Ltd., both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/976,616

(22) Filed: Nov. 24, 1997

Related U.S. Application Data

(63) Continuation of application No. 08/694,289, filed on Aug. 8, 1996, now abandoned.

(30) Foreign Application Priority Data

Aug. 11, 1995 (JP) ..... 7-206002

(51) Int. Cl.[7] ..... C22C 21/00

(52) U.S. Cl. ..... 148/415; 148/439; 148/440

(58) Field of Search ..... 148/439, 440, 148/691, 692, 689; 420/532, 533, 541, 542

(56) References Cited

U.S. PATENT DOCUMENTS

| | | | | |
|---|---|---|---|---|
| 3,743,549 | | 7/1973 | Russo et al. | 148/12.7 |
| 5,259,897 | * | 11/1993 | Pickens et al. | 420/533 |
| 5,494,540 | * | 2/1996 | Ochi et al. | 148/552 |

FOREIGN PATENT DOCUMENTS

| | | |
|---|---|---|
| 55-2757 | 1/1980 | (JP) . |
| 58-167757 | 10/1983 | (JP) . |
| 61-52346 | 3/1986 | (JP) . |
| 64-11952 | 1/1989 | (JP) . |
| 3-122240 | 5/1991 | (JP) . |
| 4-176835 | 6/1992 | (JP) . |
| WO 92/02655 | 2/1992 | (WO) . |

OTHER PUBLICATIONS

Abstract WPI/Derwent, Week 8826, of JP–A–63 114 949 (Nippon Light Metal KK May 19, 1988, (1 page).
European Search Report dated Oct. 29, 1996 (3 pages).
Communication dated Nov. 28, 1996 (1 page).

* cited by examiner

*Primary Examiner*—M. Alexandra Elve
(74) *Attorney, Agent, or Firm*—Finnegan, Henderson, Farabow, Garrett & Dunner, L.L.P.

(57) ABSTRACT

A high-strength aluminum alloy having good porthole extrudability is provided. It has a Vickers hardness Hv of not less than 40 as measured in a homogenized state created by heat treatment before extrusion and a Vickers hardness Hv of not less than 20 imparted by plastic working after the heat treatment.

8 Claims, 1 Drawing Sheet

PROCESS FOR IMPROVING THE EXTRUDABILITY OF HIGH-STRENGTH ALUMINUM ALLOYS

This application is a continuation of application Ser. No. 08/694,289, filed Aug. 8, 1996, now abandoned.

BACKGROUND OF THE INVENTION

1. Field of the Invention

The present invention relates to a high-strength aluminum alloy having good porthole extrudability.

2. Description of the Prior Art

Aluminum and aluminum alloys, when used as an extrusion material, can easily provide sections having a complicated profile, leading to the widespread use thereof in various fields such as building materials. Among such aluminum alloys, high-strength aluminum alloys, by virtue of high specific strength, have become widely utilized in various fields. Conventional high-strength aluminum alloys of the above type known in the art include JIS 2000 series (Al—Cu-base alloys), JIS 5000 series (Al—Mg-base alloys), and JIS 7000 series (Al—Zn—Mg-base alloys).

Hollow materials, such as extruded aluminum pipes, have hitherto been produced by porthole extrusion using a porthole die. In porthole extrusion, aluminum is divided in a port section of the porthole die into a plurality of portions which are again joined (welded) to each other in a chamber section to form a welded portion, thereby preparing a hollow section having a complicated profile.

However, it should be noted that although, for example, the production of components required to have abrasion resistance, such as rollers for copying machines, requires the use of abrasion-resistant aluminum alloys, such as JIS 4000 series alloys, it is impossible to conduct porthole extrusion of the JIS 4000 series alloys. In order to eliminate such a problem, Japanese Unexamined Patent Publication (Kokai) No. 4-176835 discloses an aluminum alloy containing boron.

Even in the case of porthole extrusion using this aluminum alloy, unsatisfactory welding occurs when aluminum is divided in a port section of the porthole die into a plurality of portions which are again joined to each other in a chamber section to form a welded portion. For this reason, no sound hollow sections can be provided, and, hence, only a solid section having no welded portion or a mandrel pipe can be produced and the production of hollow sections having a complicated profile is difficult.

Further, in the case of, for example, an Al—Mg-base alloy, when the Mg content exceeds 2% by weight, the welded portion in the section formed using this alloy is reported to have lowered strength and toughness. In fact, the production of hollow sections using JIS alloys 5052, 5056, and 5083 and the like by porthole extrusion is impossible, and hollow sections having a complicated profile cannot be produced by extrusion. Thus, the conventional high-strength aluminum alloys cannot be used for the production of hollow sections having a complicated profile, and, hence, the scope of applications thereof is limited.

SUMMARY OF THE INVENTION

As described above, extrusion of a conventional high-strength aluminum alloy causes unsatisfactory joining at the welded portion, making it impossible to produce hollow sections having a complicated profile. Accordingly, an object of the present invention is to provide a high-strength aluminum alloy having good porthole extrudability.

The present invention provides a high-strength aluminum alloy possessing good porthole extrudability, the aluminum alloy having a Vickers hardness Hv of not less than 40 as measured in a homogenized state created by heat treatment before extrusion and a Vickers hardness Hv of not less than 20 imparted by plastic working after the heat treatment.

According to one preferred embodiment of the present invention, the Vickers hardness Hv of not less than 20 is imparted by subjecting the aluminum alloy to plastic working, after the heat treatment, with a degree of working of not less than 40%.

In the case of the conventional high-strength aluminum alloy, the hot deformation resistance is so high that the aluminum alloy, when as such used in extrusion, cannot be satisfactorily worked and porthole extrusion thereof causes an unsatisfactory joint at the welded portion. By contrast, in the high-strength aluminum alloy according to the present invention, since the aluminum alloy is subjected to predetermined plastic working prior to extrusion, working energy is stored. This promotes recrystallization in the boundary of the welded portion at the time of rejoining, in a chamber section, of the aluminum alloy which has been divided in a port section. Consequently, a sound hollow section can be produced without causing any unsatisfactory welding.

DESCRIPTION OF THE PREFERRED EMBODIMENT

Figure 1:
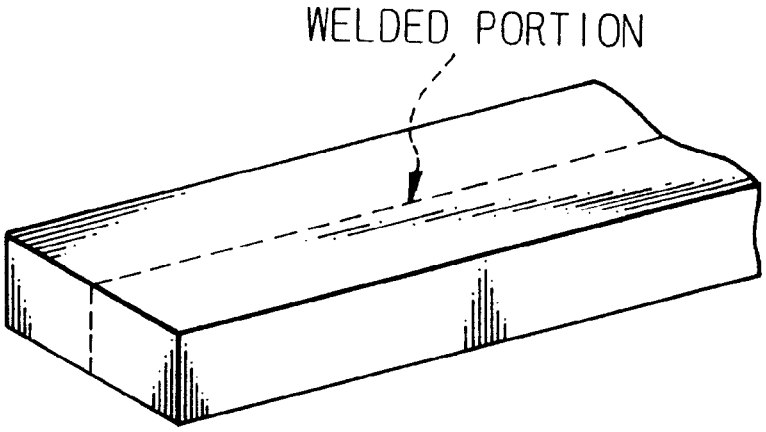
FIG. 1 is a schematic diagram showing an extruded material sample having an acceptable welded portion.

The high-strength aluminum having good porthole extrudability according to the present invention can be prepared by subjecting a high-strength aluminum alloy, which undergoes porthole extrusion, with difficulty, to plastic working, before extrusion, to impart a Vickers hardness Hv of not less than 20 to the aluminum alloy. The high-strength aluminum alloy used herein, which is undergoes porthole extrusion, with difficulty, is an aluminum alloy having an Hv of not less than 40 as measured in a homogenized state created by heat treating an ingot. Examples of such aluminum alloys include alloys specified in JIS (Japanese Industrial Standards), for example, high-Mg 5000 series alloys with not less than 2 wt.% Mg represented by alloy 5083 (Si: not more than 0.40%, Fe: not more than 0.40%, Cu: not more than 0.10%, Mn: 0.40 to 1.0%, Mg: 4.0 to 4.9%, Cr: 0.05 to 0.25%, Zn: not more than 0.25%, Ti: not more than 0.15%, and Al: balance); high-strength 7000 series alloys with not less than 1 wt.% Cu and not less than 2 wt.% Mg represented by alloy 7075 (Si: not more than 0.40%, Fe: not more than 0.50%, Cu: 1.2 to 2.0%, Mn: not more than 0.30%, Mg: 2.1 to 2.9%, Cr: 0.18 to 0.28%, Zn: 5.1 to 6.1%, Ti: not more than 0.20%, and Al: balance); and high-strength 2000 series alloys with not less than 2.5 wt.% Cu and not less than 0.5 wt.% Mg represented by alloy 2014 (Si: 0.50 to 1.2%, Fe: not more than 0.7%, Cu: 3.9 to 5.0%, Mn: 0.40 to 1.2%, Mg: 0.2 to 0.8%, Cr: not more than 0.10%, Zn: not more than 0.25%, Ti: not more than 0.15%, and Al: balance) and alloy 2024 (Si: not more than 0.50%, Fe: not more than 0.50%, Cu: 3.8 to 4.9%, Mn: 0.30 to 0.9%, Mg: 1.2 to 1.8%, Cr: not more than 0.10%, Zn: not more than 0.25%, Ti: not more than 0.15%, and Al: balance).

Further, various other aluminum alloys may be used without limitation to the above alloys, and, in this case, main constituents, additive elements, impurities and the like are not particularly limited. What is required here is that the Hv is not less than 40 as measured in a homogenized state created by heat treating an ingot. In particular, the addition of an element which, together with Al, can form, as a fine spherical dispersed particle, an intermetallic compound, can effectively conduct pinning of a dislocation to effectively store working energy, and can enhance driving force for recrystallization in the boundary of the joint, an element which can form an intermetallic compound capable of functioning as a nucleation site for recrystallization, or other elements are preferred. Examples of such elements include Zr, W, Ti, Ni, Nb, Ca, Co, Mo, Ta, Mn, Cr, V, La, and Mm's which are alloys of the above metals. In this connection, it should be noted that the aluminum alloy having an Hv of less than 40 as measured in a homogenized state created by heat treating an ingot has good porthole extrudability without plastic working before extrusion.

The homogenization by the heat treatment may be carried out by any conventional method without limitation. Specifically, the ingot of an aluminum alloy is heat-treated and cooled to remove the internal stress, thereby homogenizing the alloy. In the step of heat treatment, the alloy is held at a temperature of 440 to 550° C., and an optimal holding time is selected depending upon the alloy system used. The cooling may be carried out either by standing or by forced cooling.

The homogenized aluminum alloy ingot is then subjected to plastic working, such as forging, to create work hardening, thereby imparting a Vickers hardness Hv of not less than 20. Sufficient working energy is stored by the work hardening. For the working, there is no limitation on working temperature, degree of working, and working method so far as a Vickers hardness Hv of not less than 20 can be imparted. The degree of working is preferably not less than 40% because the Vickers hardness Hv of not less than 20 can be easily imparted. In general, however, heating is effective in imparting a degree of working of not less than 40%, and, regarding the working method, when the subsequent extrusion is taken into consideration, forging, extrusion, which provides a columnar extrudate, or the like is preferred from the viewpoint of efficiency. The plastic working temperature is preferably 400° C. or below. When it is above this temperature range, recrystallization occurs after plastic working, making it difficult for the energy to be stored. Work hardening which provides a Vickers hardness Hv of less than 20 results in no satisfactory energy storage, so that the contemplated effect cannot be attained.

EXAMPLE AND COMPARATIVE EXAMPLE

Aluminum alloys having compositions specified in the following Table 1 were cast by conventional DC casting into billets, having a size of 177ϕ×L, which were cut into a length of 200 mm. The ingots were homogenized under conditions specified in Table 1 and forged to deform the ingots in the longitudinal direction, at 300° C. and with a percentage upsetting of 40%, into a size of 230ϕ×120 mm. They were then machined to prepare billets having a diameter of 97 mm and a height of 100 mm, thereby preparing test materials, with work hardening imparted thereto, for extrusion. The test materials were extruded under conditions of billet temperature 450° C. and extrusion speed 2 m/min into plate materials having a thickness of 5 mm and a width of 50 mm. In this case, a die provided with a bridge portion for forming a welded portion and a reference die not provided with a bridge portion were used. Plate materials prepared using the die provided with a bridge portion has a welded portion in the center portion, as shown in FIG. 1. Tensile specimens were cut from the extruded plate materials so that the direction of pull would be perpendicular to the direction of extrusion, and the strength of the welded portion in the extruded materials was measured by a tensile test. The results are tabulated in the following Table 1. In the table, the strength of the plate materials having a welded portion was expressed in a proportion relative to the strength of the plate material, having no welded portion, prepared by the reference die by taking the strength of the plate material having no welded portion as 100.

For test Nos. 5 and 12, the extruded materials were subjected to solution treatment at 480° C. for 2 hr, water quenching, natural aging (standing for cooling) at room temperature for 72 hr, artificial aging (forced cooling) at 120° C. for 24 hr, and then the tensile test. For test Nos. 6 and 13, the extruded materials were subjected to solution treatment at 495° C. for 2 hr, water quenching, artificial aging at 190° C. for 12 hr, and then the tensile test. The Vickers hardness was measured for as-homogenized ingots (annealed state) and as-forged ingots.

TABLE 1

| | Chemical composition (balance: Al and impurities, unit: wt. %) | | | | | | | Homogenization of | | Vickers hardness (Hv) | | |
|---|---|---|---|---|---|---|---|---|---|---|---|---|
| No. | Mg | Cu | Zn | Mn | Cr | Mm | Zr | ingot | Forging | as-annealed | as-work-hardened | judgement |
| Ex. of Inv. | | | | | | | | | | | | |
| 1 | 5.1 | — | — | — | — | — | 0.20 | 440° C. × 24 hr | 300° C. × 40% | 72 | 24 | ○ |
| 2 | 10.0 | — | — | — | — | 0.29 | — | 440° C. × 24 hr | 300° C. × 40% | 88 | 30 | ○ |
| 3 | 2.5 | — | — | — | 0.21 | — | — | 500° C. × 10 hr | 200° C. × 40% | 50 | 21 | ○ |
| 4 | 5.0 | — | — | 0.48 | 0.15 | — | — | 500° C. × 10 hr | 300° C. × 40% | 73 | 25 | ○ |
| 5 | 2.4 | 1.3 | 5.6 | 0.10 | 0.24 | — | 0.19 | 450° C. × 12 hr | 200° C. × 40% | 65 | 22 | ○ |
| 6 | 1.3 | 4.4 | — | 0.38 | — | — | — | 480° C. × 10 hr | 300° C. × 40% | 50 | 21 | ○ |
| Comp. Ex. | | | | | | | | | | | | |
| 7 | 10.0 | — | — | — | — | 0.29 | — | 440° C. × 24 hr | 300° C. × 20% | 88 | 18 | Δ |
| 8 | 5.1 | — | — | — | — | — | 0.20 | 440° C. × 24 hr | None | 72 | 0 | x |

TABLE 1-continued

| No. | Chemical composition (balance: Al and impurities, unit: wt. %) Mg | Cu | Zn | Mn | Cr | Mm | Zr | Homogenization of ingot | Forging | Vickers hardness (Hv) as-annealed | as-work-hardened | judgement |
|---|---|---|---|---|---|---|---|---|---|---|---|---|
| 9 | 10.0 | — | — | — | — | 0.29 | — | 440° C. × 24 hr | None | 88 | 0 | x |
| 10 | 2.5 | — | — | — | 0.21 | — | — | 500° C. × 10 hr | None | 50 | 0 | Δ |
| 11 | 5.0 | — | — | 0.48 | 0.15 | — | — | 500° C. × 10 hr | None | 73 | 0 | x |
| 12 | 2.4 | 1.3 | 5.6 | 0.10 | 0.24 | — | 0.19 | 450° C. × 12 hr | None | 65 | 0 | Δ |
| 13 | 1.3 | 4.4 | — | 0.38 | — | — | — | 480° C. × 10 hr | None | 50 | 0 | x |

○: A welded portion was created, and the strength thereof was not less than 80% of that of the extruded material having no welded portion.
Δ: A welded portion was created, and the strength thereof was less than 80% of that of the extruded material having no welded portion.
x: No welded portion was created, and the material was extruded as two separate parts.
% in the column of "forging" represents the percentage upsetting.

In Table 1, the strength of the welded portion was evaluated according to the following criteria:

O: A welded portion was created and the strength thereof was not less than 80% of that of the extruded material having no welded portion.

Δ: A welded portion was created and the strength thereof was less than 80% of that of the extruded material having no welded portion.

Figure 2:
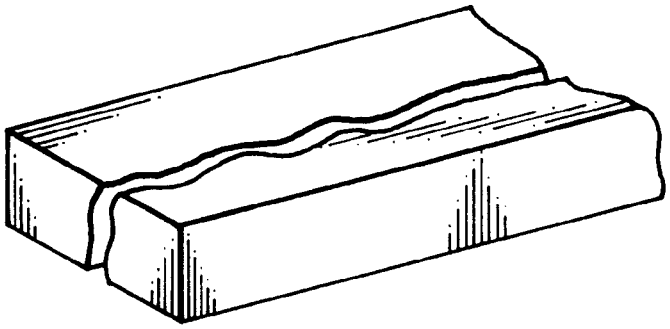
FIG. 2 is a schematic diagram showing an extruded material sample which was not successfully welded.

X: No welded portion was created, and, as shown in FIG. 2, the material was extruded as two separate parts, rendering the strength unmeasurable.

The value of the as-work-hardened in Table 1 indicates a hardness supplemented by work hardening.

For Examples 1 to 6, the strength of the welded portion was satisfactory, whereas for Comparative Example 7, the hardness of the as-work-hardened ingot was so low that the strength of the welded portion was low. For Comparative Examples 8, 9, 11, and 13, since plastic working was not conducted at all, the alloy was extruded without welding.

For Comparative Example 10 and 12, although a welded portion was created, the strength of the welded portion was low because plastic working was not conducted at all.

According to the present invention, a high-strength aluminum alloy having good porthole extrudability can be provided by subjecting a high-strength aluminum alloy, which has a Vickers hardness Hv of not less than 40 as measured in a homogenized state created by heat treating an ingot and undergos porthole extrusion with difficulty, to plastic working, thereby imparting a Vickers hardness Hv of not less than 20 to the aluminum alloy.

What is claimed is:

1. A process for forming an article formed of a high-strength aluminum alloy, said process comprising the steps of:

providing a homogenized aluminum alloy preform having a Vickers hardness Hv of 40 or more;

plastic working said preform to increase the Vickers hardness of said preform by at least 20 Hv and to store working energy in said preform; and forming said article by extruding the plastic-worked preform in a porthole extrusion process which includes the steps of:

(a) dividing said preform into a plurality of portions; and (b) welding a first of the divided portions of said preform to a second of the divided portions of said preform to form a welded portion, the welding resulting from recrystallization which occurs in a boundary area of the welded portion and is caused by the stored working energy.

2. The process of claim 1, wherein the plastic working step comprises forging said preform.

3. The process of claim 1, wherein the Vickers hardness Hv increase of at least twenty (20) is imparted by subjecting the preform to plastic working with a degree of working of not less than 40%.

4. The process of claim 1, wherein the aluminum alloy preform has been homogenized by heating the preform to 240 to 550 degrees C., holding the preform at that temperature for a period of time, and cooling the preform.

5. The method of claim 1, wherein the plastic working is carried out at a temperature of 400 degrees C. or below.

6. The process of claim 1, wherein the aluminum alloy contains: (i) not less than 2% by weight of Mg, (ii) not less than 1% by weight of Cu and not less than 2% by weight of Mg, or (iii) not less than 2.5% by weight of Cu and 0.5% by weight of Mg.

7. The process of claim 1, wherein the aluminum alloy contains at least one member selected from the group consisting of Zr, W, Ti, Ni, Nb, Ca, Co, Mo, Ta, Mn, Cr, V, La, and alloys thereof.

8. The process of claim 1, wherein the extrusion process is conducted with a porthole extrusion die.

* * * * *